United States Patent [19]

Klie et al.

[11] 4,413,548

[45] Nov. 8, 1983

[54] HYDRAULIC MOTOR WITH ADJUSTABLE FLOW VOLUME

[75] Inventors: Jurgen Klie; Walter Lubos, both of Sprockhoevel; Wilhelm Flieter, Hattingen, all of Fed. Rep. of Germany

[73] Assignee: G. Düsterloh GmbH, Sprockhoevel, Fed. Rep. of Germany

[21] Appl. No.: 357,877

[22] Filed: Mar. 15, 1982

[30] Foreign Application Priority Data

Mar. 13, 1981 [DE] Fed. Rep. of Germany ..... 3109706

[51] Int. Cl.[3] ..... F01B 1/06; F04B 21/02

[52] U.S. Cl. ..... 91/491; 417/456

[58] Field of Search ..... 417/456, 273; 91/180, 91/503, 491

[56] References Cited

U.S. PATENT DOCUMENTS 3,152,556 10/1964 Woydt ..... 417/456

3,790,307 2/1974 Aldinger ..... 91/472

*Primary Examiner*—William L. Freeh

*Attorney, Agent, or Firm*—Michael J. Striker

[57] ABSTRACT

A radial or axial piston type hydraulic motor has a plurality of cylinders connected by pressure conduits to a pressure fluid distributor. A check valve spring-biased in closing direction is built in at least one pressure conduit and has a first surface portion acted upon by pressure from the cylinder, a second surface portion which is exposable to pressure fluid from the distributor to act on the check valve either in opening direction or in closing direction and a third surface portion exposed to a control pressure in opening direction. The second surface portion being at least as large as the first surface portion and larger than the third surface portion, and the combined area of the first and second surface portions exceeding the surface area of the second surface portion.

9 Claims, 6 Drawing Figures

HYDRAULIC MOTOR WITH ADJUSTABLE FLOW VOLUME

BACKGROUND OF THE INVENTION

The present invention relates in general to adjustable hydraulic motors, and in particular to an axial or radial piston type hydraulic motor having at least two cylinder blocks with pistons cooperating with a crankshaft or with a guiding reaction member, a fluid flow distributor, intake and return pressure conduits between the distributor and the cylinders, and at least one pressure-actuated control valve arranged in the pressure conduit.

Adjustable hydraulic motors of this kind have the advantage that, at the same volume of flow, different rotary speeds of the motor can be obtained. For this purpose, the stroke volume of the pistons changes during each rotation. If high efficiency even at low rotary speeds or higher rotary moments are required, the radial piston type adjustable hydraulic motors are preferably employed. If radial piston type hydraulic motors are used where the pistons are in contact with an inner rotor, then the individual valves are arranged usually in the fluid distributing conduits between the cylinder blocks and the pressure fluid distributor and are operated by a switching pressure. When the pistons or cylinders of the motor are disconnected from the pressure fluid source by means of these control valves, then the motor is capable of operating in two or more different operational conditions. The control valves are arranged between the pressure fluid distributor and the cylinder blocks in such a manner that in a switching position "low volume stroke", then all or a group of the cylinders are connected to each other. In this condition, an exchange of pressure fluid takes place between the cut off cylinders and produces oscillation of corresponding pistons. Moreover, in order to neutralize kinematic irregularities and leakage, a connection between the cut off cylinders with the intake or return conduits or with the leakage collecting space is established.

A disadvantage of these known hydraulic motors designed for disconnecting the pistons is the loss in efficiency resulting due to the oscillating pistons and due to the exchange of pressure fluid between the disconnected cylinders. These losses tend to increase when the switched off pistons are continuously acted upon by the intake pressure. It is true that in this case the pistons are effectively forced against a crankshaft of a radial piston engine or against a guiding reaction member of an axial piston engine, but due to high intake pressures a relatively strong heating of the motor parts takes place, which in turn may cause the occurrence of excessive frictional forces which may lead to the danger of seizure of the pistons. If the switched off pistons are acted upon by the return pressure, then particularly in the case of high rotary speeds the pistons are susceptible to disengagement from the crankshaft or from the guiding track because the aforementioned pressing force is absent. As a consequence, the achievable rotary speed is limited. In addition, another disadvantage of the prior-art solution is the fact that, due to the continuous exchange of pressure fluid between the switched off cylinders, no fresh pressure fluid is admitted. The pressure fluid flowing back and forth in the disconnected cylinders is subject to a relatively strong heating which causes an additional loss in efficiency. Depending on the design and the degree of overlap of the control valves, excessively high pressure peaks in the leakage pressure or in the cylinder space may be generated when the switchover is made while the motor is running. Since the control valves usually have a negative overlap, there is a danger that, at low rotary speeds of the motor, no switchover of the cylinders is produced when the switching pressure collapses due to the leakage in the region of the overlap.

SUMMARY OF THE INVENTION

It is therefore a general object of the present invention to overcome the aforementioned disadvantages.

More particularly, it is an object of the invention to provide an improved hydraulic motor of the aforementioned type in which the oscillations of pistons and the resulting friction and heating is eliminated.

An additional object of the invention is to provide such an improved hydraulic motor which is reliably switchable both at extremely low and extremely high rotary speeds and pressures by using intake pressure for switching in all stages of the volume of the flow.

A further object of the invention is to provide such an improved hydraulic motor in which excessive peaks in leaking pressure or in the cylinder space pressure are avoided.

In keeping with these objects, and others which will become apparent hereafter, one feature of the invention resides, in a hydraulic motor of the above described type, in the provision of at least one check valve acting as the pressure-actuated control valve in the pressure conduit, the check valve being spring-biased in closing direction with a relatively weak force and having a first surface portion exposed in the opening direction to pressure fluid from a cylinder, a second surface portion exposable to pressure fluid either in opening direction or in closing direction, depending on the relative position of the distributor to the pressure conduits, and a third surface portion exposed to working fluid in opening direction, the second surface portion being at least as large as the first surface portion and larger than the third surface portion, and the combined area of the first and third surface portions being larger than that of the second surface portion.

By virtue of the particular ratios of the three active surface portions of the valve, it is ensured that, even if no pressure in opening direction acts on the valve, a stream of pressure fluid can flow from the cylinder through the check valve to the distributor but not from the distributor to the cylinder. As a consequence, if the piston is momentarily in its upper dead center point, it remains in this position even when, for example, a crankshaft of a radial piston motor moves in the direction toward the lower dead center point and thus disengages from the crankshaft. If, on the other hand, the piston is momentarily situated in the lower dead center point, then it will be displaced by the movement of the crankshaft in the direction toward the upper dead center point. In this case, a pressure is built up in the cylinder, which opens the check valve, and the pressure fluid is discharged through the return or discharge conduit. In approaching the upper dead center point, the speed of the piston diminishes, and also the pressure in the cylinder decreases. This pressure decrease continues for so long until the relatively weak biasing force acting on the check valve in closing direction overcomes the pressure in the cylinder and the check valve resumes its closing position. Even in this closing position the piston is brought to a standstill in its upper dead center point when the crankshaft keeps moving in the direction to the lower dead center point, because no pressure fluid is supplied.

Even if pressure in opening direction is applied on the check valve, the latter remains in its closed position as long as the crankshaft is moving in the direction to the lower dead center point. Due to the particular ratios of the active surface portions of the check valve according to this invention, the opening pressure in this position of the crankshaft is insufficient to open the check valve. Only after the pressure fluid distributor in the lower dead center point connects the closed cylinder with the return conduit, the ratio of forces acting on the check valve is changed, and the opening pressure becomes effective and opens the check valve.

If the return fluid equals in pressure the leakage fluid, then the piston, while the check valve is open, remains in its upper dead center point until the crankshaft reaches the upper dead center point and the pressure fluid distributor connects the check valve to the return pressure. Only after the return pressure exceeds the leakage pressure, does the piston move against the crankshaft by the resulting, relatively low pressure difference. The application of high pressure against the piston starts only in the upper dead center point, so that no hard impact of the piston against the crankshaft ever occurs.

After opening of the check valve by the opening pressure, the check valve is subject to pressure differences resulting from viscous friction. These pressure differences however are never large enough to reclose the check valve. The latter thus remains open until the opening pressure is again removed. Only then do the forces acting in the closing direction, in combination with the flow forces of the pressure fluid, cause the closing of the check valve.

Due to the particular construction of the adjustable volume hydraulic motor of this invention, no high leakage pressures can be generated, inasmuch as the intake pressure is never temporarily directly connected to the leakage space. The check valves are designed substantially without any overlap, and consequently the leakage is very low. For this reason, there is no danger of stoppage of the motor due to the leakage through the valve.

After switching the motor into the "fast run" position, the piston in the disconnectable cylinder can still perform a stroke up to its upper dead center point, and in doing so the volume of working fluid in the cylinder is discharged into the return conduit. In the upper dead center point, the piston remains still and disengages from the crankshaft or from its guiding track.

After switching over the motor into its "slow run", the check valve opens only then when the pressure fluid distributor connects the check valve to the return conduit. Accordingly, high pressure can never reach the piston while the latter is disengaged from the crankshaft or from the guiding track.

Moreover, a substantial advantage of this invention resides in the fact that intake pressure is employed as the switching pressure for the check valve. As a result, the motor is switchable without any limitations in all stages of flow volume at all pressures and rotary speeds.

The small biasing force acting in the closing direction of the check valve is, as mentioned before, produced by a resetting spring or, in a modification, can be produced by an additional valve surface portion acted upon by a small pressure. The resetting force causes the check valve to be capable of closing even under pressure-free conditions. The biasing spring thus closes the check valve even after its switching over to "small flow volume". The piston which has just been switched off still is displaced during its return stroke into the cylinder and reaches its upper dead center point. In other words, if no resetting force be available, then, after the switchover of the pressure fluid distributor to the intake pressure level, the pressure-dependent closing of the check valve, a small stream of working fluid would reach the piston. This small stream might consequently displace the piston from its upper dead center point and the piston would be prevented from remaining in the rest position in this point.

According to a preferred embodiment of the basic idea of this invention, the hydraulic motor has more than two cylinders and more than one check valve, and the surface portions of the check valves are acted upon in the opening direction either in groups or altogether by the opening pressure. As a result of this measure, it is possible to switch on any desired number of flow volumes. It also permits an interconnection of check valves belonging to one group in such a manner that only a single control connection is needed. This connection can be effected for example by suitable channels formed in the motor housing. An interconnection of disconnected cylinders is, however, excluded.

In a preferred embodiment of this invention, each check valve is formed in a stepped recess in the motor housing, and by a spring-biased differential piston slidably guided in the recess and defining the three surface portions acted upon by the pressure fluid. The differential piston defines a well receiving a biasing spring and at its closed end is formed with transverse channels and with an annular surface exposable to the pressure fluid. This annular surface is smaller than the surface facing the pressure fluid distributor and acted upon by the intake or return pressure.

The closed end of the differential piston is in the form of a frustoconical head cooperating with a valve seat which is formed in a bottom opening of a sleeve-like insert. The diameter of the base of the frustoconical head is smaller than the part of the differential piston which is guided in the sleeve-like insert; the latter part is stepped down relative to the part of the piston which faces the pressure fluid distributor. The advantage of this construction is in the fact that the parts performing the opening function are integral with the check valves and consequently no other additional component parts for opening the valve are necessary. This feature is of great importance because the check valves applicable for this invention should be of small size and at the same time be strong and capable of withstanding large loads.

Another advantageous modification of this invention is a construction of the check valve in which a valve body is spring-biased against a valve seat and cooperates with an opening plunger which is acted upon to displace the valve body in opening direction. Preferably, the valve body has a spherical configuration which is urged into its closing position on the valve seat by a helical pressure spring. The valve body can be also of a conical shape. The surface which is exposed to the opening pressure in this embodiment is formed by a piston connected to an opening plunger. To open the check valve it suffices to overcome the spring force acting on the closing body, provided of course that a resetting pressure acts on the valve.

In this embodiment, the vectors of forces acting on the opening plunger and on the closing valve body can be directed either coaxially or at an angle to each other, such as at a right angle for example. Which of these possibilities is to be employed depends in practice on technological and manufacturing requirements.

If the hydraulic motor of this invention is a radial piston type motor, it is of advantage when the check valves are arranged in a disk-shaped part of the motor housing which surrounds the crankshaft. The maintenance of the motor is made considerably easier, and the component parts of the motor can be mass-produced in series.

The novel features which are considered characteristic for the invention are set forth in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
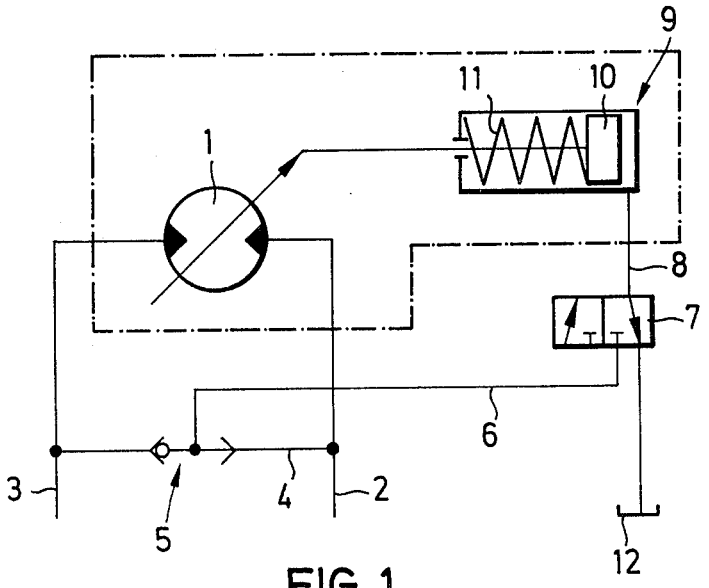
FIG. 1 is a schematic diagram of a hydraulic motor operable at two different flow volumes.

Referring firstly to FIG. 1, reference numeral 1 indicates a flow adjustable hydraulic motor of the radial or axial piston type. Working fluid is fed into the motor 1 through conduits 2 and 3, of which one is the high-pressure conduit and the other one is the return conduit. Depending on which of the two conduits 2 and 3 supplies high pressure fluid, the direction of rotation of motor 1 is determined.

A conduit 4 with a changeover valve 5 connects the pressure conduits 2 and 3. The changeover valve is connected through conduit 6 to a 3/2 directional control valve 7 and ensures that one of the conduits 2 or 3 which is under higher pressure is brought in communication with directional control valve 7. A schematically illustrated adjuster 9 having a piston 10 coupled to the hydraulic motor 1 and a biasing spring 11 for setting the piston 10 into its starting position is hydraulically connected through conduit 8 to the directional control valve 7.

In the illustrated position, the 3/2 directional control valve is adjusted such that the intake flow of switching pressure fluid is disconnected from the cylinder of adjuster 9, while the return flow is discharged by the action of return spring 11 and the piston 10 through conduit 8 and the control valve 7 into a tank 12. Under these conditions, the hydraulic motor 1 is set into its fast run position.

If the 3/2 directional control valve 7 is displaced into its other working position, pressure fluid from high-pressure conduit 2 flows through conduit 6, the 3/2 valve 7 and the conduit 8 into the adjusting cylinder-and-piston unit 9 and moves piston 10 against the spring 11, thus shifting the hydraulic motor 1 into its slow running position.

Figure 2:
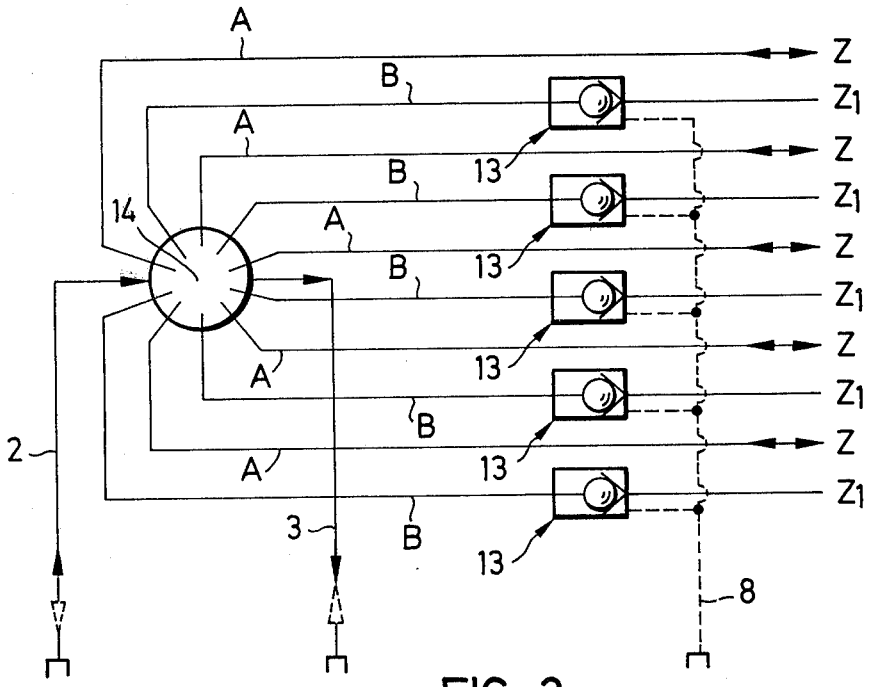
FIG. 2 is a schematic diagram of a hydraulic motor having check valves according to this invention and operating either with five or ten pistons.

FIG. 2 shows schematically an arrangement and function of a hydraulic motor 1 formed with ten radial pistons of which all ten, or alternatively only five, can be activated by the aid of check valves 13.

It is assumed that in this example the intake high-pressure fluid is applied to the hydraulic motor through conduit 2 and the return fluid is discharged through conduit 3. The flow volume from conduit 2 first passes through a fluid distributor 14 forming the component part of the hydraulic motor 1 (FIG. 1). The distributor 14 directs the flow in dependence on its angular position to distributing conduits A and B arranged between the ports of the distributor 14 and the non-illustrated cylinder blocks Z and Z1 of the hydraulic motor 1. The distributing conduits A are directly connected to the cylinders Z, while the other distributing conduits B include the check valves 13 controllable through a common control conduit 8 to take an open or a closed position. The control conduit 8, corresponding to that in FIG. 1, is connectable through the directional control valve 7 and the changeover valve 5 to that pressure fluid conduit which is under high pressure, that is, in this example, to the conduit 2.

The check valves 13 are movable between the aforementioned two switching positions. If the control conduit 8 is pressure-relieved, no flow volume from the distributor 14 can reach the cylinders Z1. In contrast, flow volumes directed from the cylinders Z1 to the pressure fluid distributor 14 are not closed by the check valves 13. If control conduit 8 is brought under pressure, the check valves 13 are substantially opened and cannot perform any blocking function against the stream volume both from the cylinders Z1 toward the distributor 14, and vice versa.

A more detailed construction and the mode of operation of the check valves 13 is illustrated in connection with a radial piston type hydraulic motor 1 according to FIG. 3.

Reference numeral 15 indicates a housing of the radial piston hydraulic motor 1 which further includes a crankshaft 16. The crankshaft is supported for rotation in the housing 15 in roller bearings 17. The crankshaft is formed with an eccentric 18 which engages pistons 20. In the example according to FIG. 2, the motor housing 15 is formed with ten cylinder blocks Z and Z1, in which the pistons 20 are slidably guided. The outwardly projecting end 21 of shaft 16 serves as a driving part, the opposite end 22 of shaft 16 supports another eccentric 23 which is surrounded by an annular pressure fluid distributor 14 and spaced from the latter by roller bearings 24. The pressure fluid distributor 14 is designed such that, depending on the angular position of the crankshaft 16, the distributing conduits A and B communicating with the cylinders Z and Z1 are alternately connected to a port 19 for the intake pressure fluid or with a port 25 for the return fluid. In this example, it is assumed that the port 19 is connected to the high-pressure intake conduit.

Figure 3:
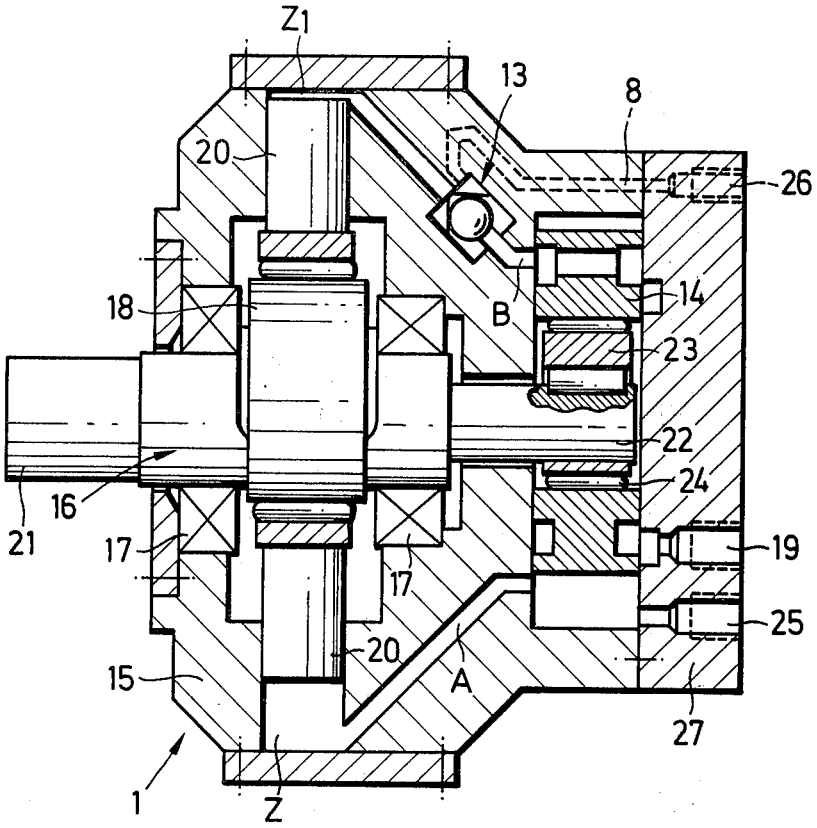
FIG. 3 is an axial section of a radial piston type hydraulic motor.

It will be seen from FIGS. 2 and 3 that the check valves 13 are assigned to the distributing conduits B, while the adjoining distributing conduits A connected to the high-pressure intake port 19 are without check valves. All of the check valves 13 are connected through a common annular grinding channel in housing 15 to the control conduit 8 leading to the control port 26. The control port 26, the intake high-pressure port 19, and the return port 25 are located in a common end plate 27 of the motor housing 15. If an opening pressure fluid, branched for example from the high-pressure intake fluid, is applied to the control port 26, all check valves 13 are simultaneously acted upon and, provided that return pressure acts against the valving element of check valves 13, the latter are simultaneously opened. The high-pressure flow volume applied through the intake port 19 is distributed through the pressure fluid distributor 14 to the distributing conduits A and B in accordance with the order of movement of the pistons 20. Depending whether the control port 26 is supplied with pressure fluid or not, the radial type motor 1 can be operated either with the actuation of all cylinders Z and Z1 or with the cylinders Z only.

The function of the radial piston type hydraulic motor 1 according to FIG. 3, namely the disconnection of a part of its pistons by means of check valves 13 in the distributing conduit B leading to the assigned cylinders Z1, will now be explained in greater detail.

At a pressure-free condition of the control port 26, the check valves 13 are closed and no pressure fluid can reach through the distributor 14 the cylinders Z1. Pistons 20 remain during the rotary movement of the eccentric 18 in the direction toward the lower dead center point in their illustrated positions and are therefore disengaged from the eccentric 18.

If a piston 20 is in its lower dead center point, and if eccentric 18 rotates in direction toward the upper dead center point, the piston is displaced in its cylinder Z1 and a pressure builds up in the cylinder Z1, which opens check valve 13. As a result, pressure fluid from cylinder Z1 is discharged through the return port 25. In the range of the upper dead center point, the speed of movement of piston 20 starts slowing down, pressure in the cylinder correspondingly decreases, and the check valve 13 resumes its closing position. As a consequence, piston 20 remains in its upper dead center point.

If pressure is being applied to the control port 26, which in the example according to FIGS. 1 and 2 is achieved by the application of the intake high pressure, nothing will happen as long as the crankshaft eccentric 18 keeps moving in the direction towards the lower dead center point because, as will be explained below with reference to FIGS. 4–6, the active surface portions on the valving element of check valve 13 are designed such that the opening pressure is not high enough to open the valve 13.

In the lower dead center point, distributor 14 connects the distributing conduit B with the return port 25, thus changing the pressure and force conditions on the check valve 13 so that the latter opens.

If the pressure of return fluid equals the pressure of leakage fluid, the piston 20 remains in its upper dead center point until the eccentric 18 reaches the upper dead center point and the distributor 14 reconnects the distributing conduit B to the high-pressure intake port 19.

If the return pressure exceeds the leakage pressure, piston 20 is slowly moved by the mostly minute pressure difference against the eccentric 18, but in any case the piston is acted upon by the high pressure only in its upper dead center point where the eccentric 18 is brought into engagement with the piston 20.

A pressure difference resulting from the viscous friction still acts on the open check valve 13. This small pressure difference, however, is not sufficient to close valve 13 and the latter remains open so long until the feeding of opening pressure fluid is interrupted.

Figure 4:
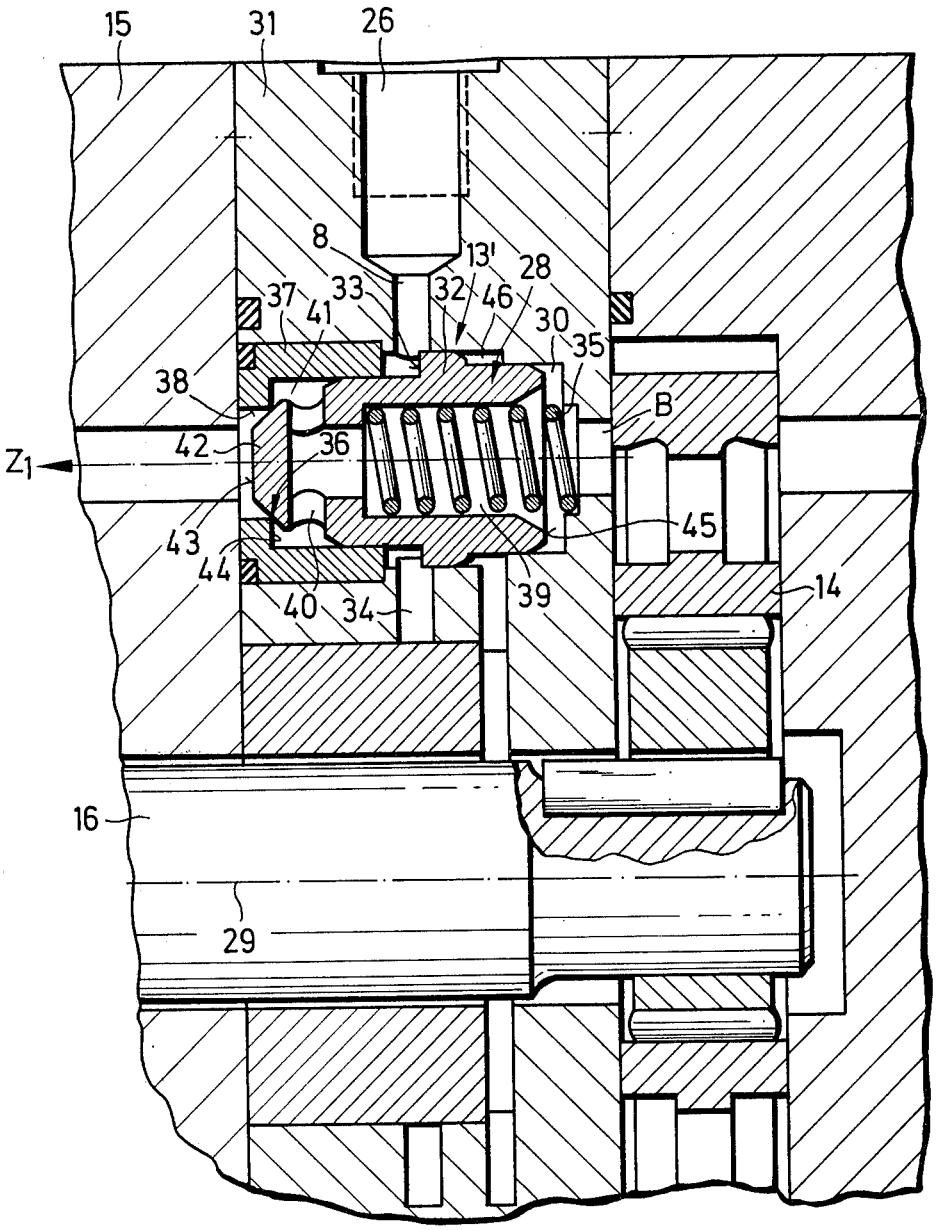
FIG. 4 is an axial section of a cut away part of a first embodiment of the radial piston type hydraulic motor according to this invention.

A first embodiment of the check valve 13 (FIGS. 2 and 3) is illustrated in FIG. 4. In this embodiment, check valve 13' includes a differential piston 28 which is sealingly guided parallel to the axis of rotation 29 of the crankshaft 16 in a stepped recess 30 in the disk-shaped part 31 of the motor housing 15. The cylindrical wall of the differential piston 28 is formed at its central region with a projecting collar 32 defining an annular surface portion 33 movable in the range of control conduit 8 so as to be acted upon by the opening pressure fluid from the control port 26. The control conduit 8 opens into a ring-shaped channel 34, and the corresponding surface portions 33 of the remaining check valve 13 move simultaneously in the channel 34 in response to the control pressure from the conduit 8.

In a pressure-free or unactuated condition, the differential piston 28 is acted upon by a helical pressure spring 35 to engage sealingly a valve seat 36 constituted by a bore 38 in one end of a sleeve-like insert 37. The sleeve 37 is fixedly mounted in the stepped recess 30 of the housing port 31. The biasing spring 35 is inserted into a stepped bore 39 in the differential piston 28. The open end of the bore 39 faces the pressure fluid distributor 14, and the other end thereof communicates via radial channels 40 with the interspace 41 surrounding in the sleeve 37 the closing head 42 of the piston 28. The surface portion 43 of the end face of the closing head 42, corresponding to the cross section of the bore 38 in the sleeve 37, produces upon the application of a pressure fluid a force which acts in the opening direction against the biasing spring 45. As mentioned previously, a control pressure acting on the annular surface 33 can be derived from the opening pressure. Moreover, an additional force in closing direction is applicable on the annular surface portion at the other end face of the differential piston 28 when high pressure fluid is applied thereto from the distributor 14. This additional force acting on the surface portion 45, however, is counteracted by a force resulting on the annular bottom surface portion 44 around the circumference of the valve seat 36. The annular interspace 46 between the stepped part of the bore 30 and the jacket of piston 28 adjoining the collar 32, has no other function than to collect leaking fluid and discharge the same into a leakage fluid space of the motor 1.

In FIG. 1, differential piston of the check valve 13' is illustrated in its closed working position in which at any pressure the flow volumes from the distributor 14 to the cylinder Z1 are prevented by the hydrostatic resultant action of forces acting in cooperation with the spring 35 on the differential piston.

If control pressure at control port 26 is discontinued, and if high pressure intake fluid is applied against the check valve 13', the pressure applied in opening direction is not large enough to open the check valve 13' because the combined magnitude of the effective surface portions 44 and 45 acted upon by the pressure fluid hold the valve 13' in its closed position in spite of the applied opening pressure.

The check valve 13' can open only then when return pressure fluid is present in the distributor conduit B, since the resulting hydrostatic ratio of forces acting on the effective surfaces of piston 28 initiate a movement of the latter against the biasing spring 35. Once the check valve 13' is open, however, it remains in this position even when the distributor 14 reconnects the distributing conduit B to the intake port 19 because the surface portions 43 and 33 which are acted upon by the pressure fluid from the cylinder and by the opening pressure fluid, are larger than the difference of surface portions 45 and 44 acted upon by the intake pressure fluid.

Figure 5:
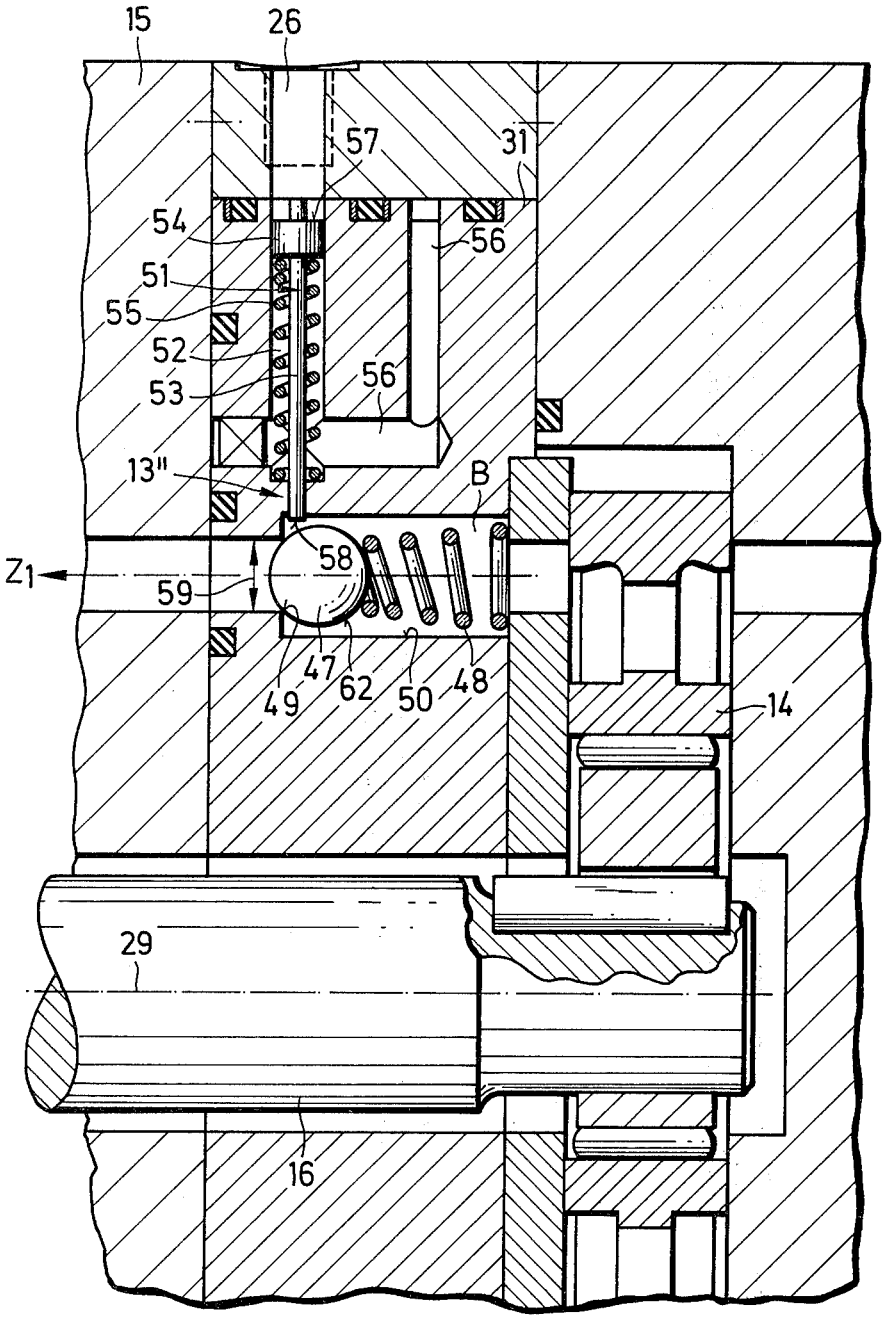
FIG. 5 is a view similar to FIG. 4 showing a modification of the check valve.

In the embodiment according to FIG. 5, the check valve 13'' is constituted by a spherical valving element 47 which is biased by a helical compression spring 48 against a valve seat 49. The effective direction of the closing spherical body 47 extends parallel to the axis of rotation 29 of the crankshaft 16. The closing body 47 and the helical spring 48 are located in an extension 50 of the distributing conduit B.

For actuating the check valve 13'', there is provided an unsealing plunger 51 which is guided in a radial bore 52 in a disk-shaped component part 31 of the motor housing 15. The unsealing plunger 51 is constituted by a pin 53 which at one end cooperates with the spherical valving body 47 and at its other end is provided with a piston 54 spring-loaded by a helical spring 55 in the direction against the control port 26. The bore 52 is connected through channel 56 with the leakage space of the hydraulic motor 1.

If it is desired to open the check valve 13'', an unsealing pressure is applied to the control port 26 which displaces the plunger 51 against the spherical surface of the valving body 37 and lifts the same against the biasing force of the spring 48 from the valve seat 49. This action of course is possible only when the return fluid pressure is present in the distributing conduit B. If, however, a high pressure is applied in the distributing conduit B, the check valve 13'' remains closed even if unsealing pressure is applied to the control port 26. This feature is made possible by the ratio of magnitude of surface portions 57 and 58 on the opening plunger 51 to the cross-sectional area 59 of the valve seat 49 and to the surface portion 62 of the valving body 67 which is acted upon by the biasing spring 48 and by the high-pressure intake fluid.

Figure 6:
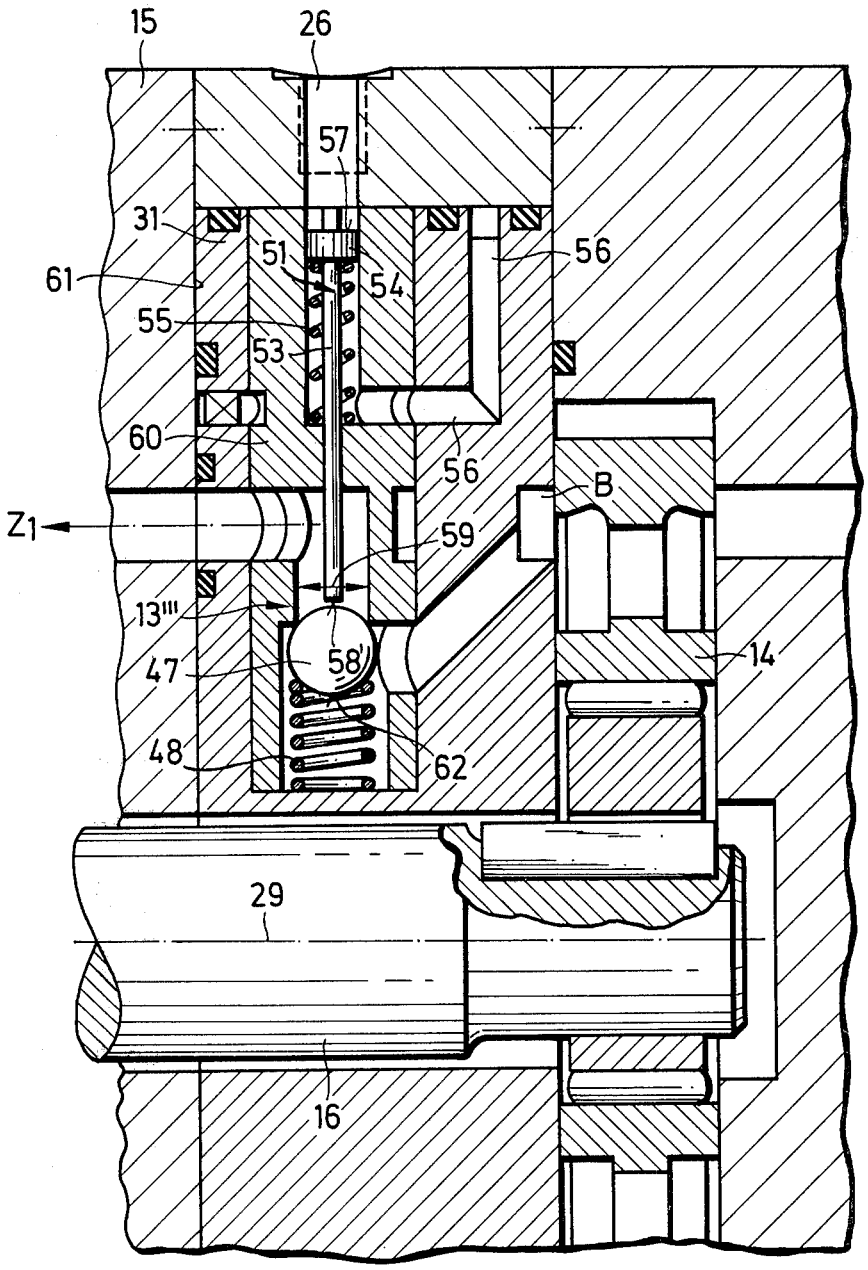
FIG. 6 is a view similar to FIG. 5 showing still another modification of the check valve.

The embodiment of FIG. 6 corresponds substantially to the embodiment of FIG. 5, therefore like component parts are indicated with corresponding reference numerals. The difference is only in the arrangement of the spherical valving body 47 relative to the control plungers 51, namely the direction of movement of the check valve 47 coincides with the movement of the plunger and is directed at right angles to the axis 29 of the crankshaft 16. The check valve 13''' together with the control plunger 61 are arranged in a common valve block 60 which is inserted in a radial bore 61 in the disk-shaped component part 31 of the motor housing 15.

It will be understood that each of the elements described above, or two or more together, may also find a useful application in other types of constructions differing from the types described above.

While the invention has been illustrated and described as embodied in a driving hydraulic machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An adjustable, axial or radial piston type hydraulic motor having at least two cylinders and pistons cooperating with a rotary crankshaft or with a reaction guiding member, a fluid flow distributor, intake and return pressure conduits provided between the distributor and the cylinders, comprising at least one pressure-actuated control valve arranged in one of said pressure conduits, said control valve being a check valve spring-biased into its closing position by a relatively weak biasing means, said check valve being formed with a first surface portion exposed in its opening direction to pressure fluid from said cylinder, a second surface portion exposable to pressure fluid either in opening direction or in closing direction depending on the relative position of said distributor to the pressure conduit for the check valve, and a third surface portion exposable to working fluid in opening direction; said second surface portion being at least as large as said first surface portion and larger than said third surface portion, and the combined areas of said first and third surface portions being larger than the area of said second surface portion.

2. A hydraulic motor as defined in claim 1, wherein the number of cylinder-and-piston units exceeds two and the number of check valves exceeds one, and wherein the surface portions of the check valves exposable to pressure fluid in the opening direction are acted upon by the pressure fluid simultaneously.

3. A hydraulic motor as defined in claim 1, further including a motor housing formed with at least one stepped recess for receiving the check valve.

4. A hydraulic motor as defined in claim 3, wherein said check valve includes a valve seat communicating with said cylinder, a differential piston formed at one end thereof with a valving body defining said first surface portion, an open other end thereof defining said second surface portion, and further including a peripheral collar defining said third surface portion.

5. A hydraulic motor as defined in claim 4, wherein said differential piston is formed with a well for accommodating said biasing means.

6. A hydraulic motor as defined in claim 3, wherein said motor housing includes a disk-shaped housing part surrounding said crankshaft or reaction guiding member and being formed with recesses for accommodating said check valves.

7. A hydraulic motor as defined in claim 1, further including a control port, said check valve including a valve seat and communicating with said cylinder and a spherical valving body spring-biased in closing direction against the valve seat, and a spring-biased plunger communicating with said control port and being engageable with said valving body to displace the same in opening direction when actuated.

8. A hydraulic motor as defined in claim 7, wherein the path of movement of said valving body is at right angles to the path of movement of said plunger.

9. A hydraulic motor as defined in claim 7, wherein the path of movement of the valving body is in alignment with the path of movement of said plunger.

* * * * *